United States Patent [19]

Keeton

[11] Patent Number: 5,037,369

[45] Date of Patent: Aug. 6, 1991

[54] VERTICAL FOLDING STACKER

[76] Inventor: J. Herbert Keeton, 747 Meader St., Campbellsville, Ky. 42718

[21] Appl. No.: 480,900

[22] Filed: Feb. 16, 1990

[51] Int. Cl.[5] ..... B65H 45/18

[52] U.S. Cl. ..... 493/444; 493/445; 198/626.1

[58] Field of Search ..... 493/444, 445; 198/604, 198/606, 626.1, 626.2

[56] References Cited

U.S. PATENT DOCUMENTS

| | | | |
|---|---|---|---|
| 1,980,532 | 5/1930 | Kahn | 493/444 |
| 3,339,914 | 9/1967 | Grantham | 493/444 |
| 3,880,274 | 4/1975 | Bechtloff et al. | 198/604 X |

FOREIGN PATENT DOCUMENTS

| | | | |
|---|---|---|---|
| 0035870 | 4/1954 | Poland | 198/626.2 |

*Primary Examiner*—Frederick R. Schmidt
*Assistant Examiner*—John Marlott
*Attorney, Agent, or Firm*—Nixon & Vanderhye

[57] ABSTRACT

Flexible drapable sheets, such as cloth sheets or garments, are folded and stacked. A first horizontal conveyor conveys the garments past an automatic sewing machine to a lifting device which engages a middle portion of the garment and stuffs it into the inlet of a vertical second conveyor formed from two sets of horizontally spaced conveyor tapes. At a discharge end of the second conveyor, the garments are discharged onto a receiving surface formed by a number of bent wire sections interleaved with the conveyor tapes of the second conveyor. The receiving surface is flipped over (pivoted about a horizontal axis) to flip the folded over garment onto a platform above the first conveyor. The garments are stacked to a desired height on the platform.

17 Claims, 2 Drawing Sheets

VERTICAL FOLDING STACKER

BACKGROUND AND SUMMARY OF THE INVENTION

There are many operations in the handling of flexible, drapable sheets of material (such as cloth, and garments made from cloth) wherein it is desirable to fold and stack the sheets. This is particularly so in garment handling operations where a piece of cloth to be formed into a garment is acted upon (e.g. hemmed) by an automatic sewing machine at one station, and then is to be further acted upon at another station. Oftentimes the folding and stacking operations are performed manually, which is a relatively slow and tedious process.

According to the present invention, a method and apparatus are provided for automatically folding and stacking flexible drapable sheets of sheet material, particularly pieces of cloth that are used in garment manufacture. The apparatus and method are preferably used in conjunction with an automatic sewing machine which effects hemming, or otherwise acts upon, the cloth sheets.

According to one aspect of the present invention apparatus for automatic folding and stacking flexible and drapable sheets of sheet material is provided, comprising the following elements: A first, generally horizontally extending, conveyor means for conveying flexible and drapable sheets. A second, generally vertically extending conveyor means for conveying flexible and drapable sheets, having a first, intake end, disposed just above a portion of the first conveyor means, and a second, discharge end, disposed vertically above the intake end. Lifting means for lifting a flexible and drapable sheet conveyed by the first conveyor means so that it operatively engages the first end of the second conveyor means; and stacking means operatively disposed at the second end of the second conveyor means for stacking flexible and drapable sheets discharged from the second conveyor means discharge end.

The stacking means preferably comprises a stacking platform disposed above the first conveyor, and means for transferring the flexible drapable sheets from the second conveyor to the stacking platform. The transferring means preferably comprises means defining a flexible and drapable sheet receiving surface (such as a plurality of bent wire sections) having a free end and a pivoted end, means for pivotally mounting the surface at the pivoted end for pivotal movement about a horizontal axis, and means for pivoting the surface about the axis from a first position in which the free end is adjacent the discharge end of the second conveyor, to a second position in which the surface overlies the stacking platform. The first and second conveyors preferably are horizontally spaced conveyor tapes, and the bent wire sections may be interleaved with the second conveyor tapes in the first position thereof. The lifting means comprises a generally vertically extending element and means for moving that element from a position operatively beneath the first conveyor to a position so that it operatively extends above the first conveyor for engaging the flexible drapable sheet transported thereby and stuffs it into the second conveyor intake end.

According to another aspect of the present invention, apparatus for stacking flexible and drapable sheets is provided. The apparatus comprises: A generally vertically extending conveyor means for conveying flexible and drapable sheets, having a first, intake end, and a second, discharge end, disposed vertically above the intake end; and stacking means operatively disposed at the second end of the second conveyor means for stacking flexible and drapable sheets discharged from the conveyor discharge end, the stacking means comprising: a stacking platform, and means for transferring flexible drapable sheets from the conveyor means to the stacking platform.

According to another aspect of the present invention there is provided a method of folding and stacking drapable cloth sheets. The method comprises the steps of substantially sequentially and automatically: (a) Conveying the drapable cloth sheet with the first conveyor in a generally horizontal direction. (b) While practicing step (a), moving a central portion of each sheet into operative association with the second conveyor, so that the sheet is essentially folded over while engaged and conveyed by the second conveyor. (c) Conveying the sheet vertically upwardly and discharging it at a vertical position higher than the first conveyor; and, (d) stacking the discharged structures at a vertical position above the first conveyor. Step (d) is preferably practiced by automatically discharging each sheet onto a pivotal surface, and automatically effecting pivotal movement of the surface about a horizontal axis so that the sheet carried thereby will be flipped over about a horizontal axis and fall on top of the platform, or other sheets on top of the platform. During the practice of step (a) the cloth sheets are acted upon by an automatic sewing machine (e.g. hemmed).

It is a primary objective of the present invention to provide for the simple yet effective automatic folding and stacking of flexible and drapable sheets, such as cloth sheets in garment manufacture. This and other objects of the invention will become clear from an inspection of the detailed description of the invention and from the appended claims.

DETAILED DESCRIPTION OF THE DRAWINGS

Figure 1:
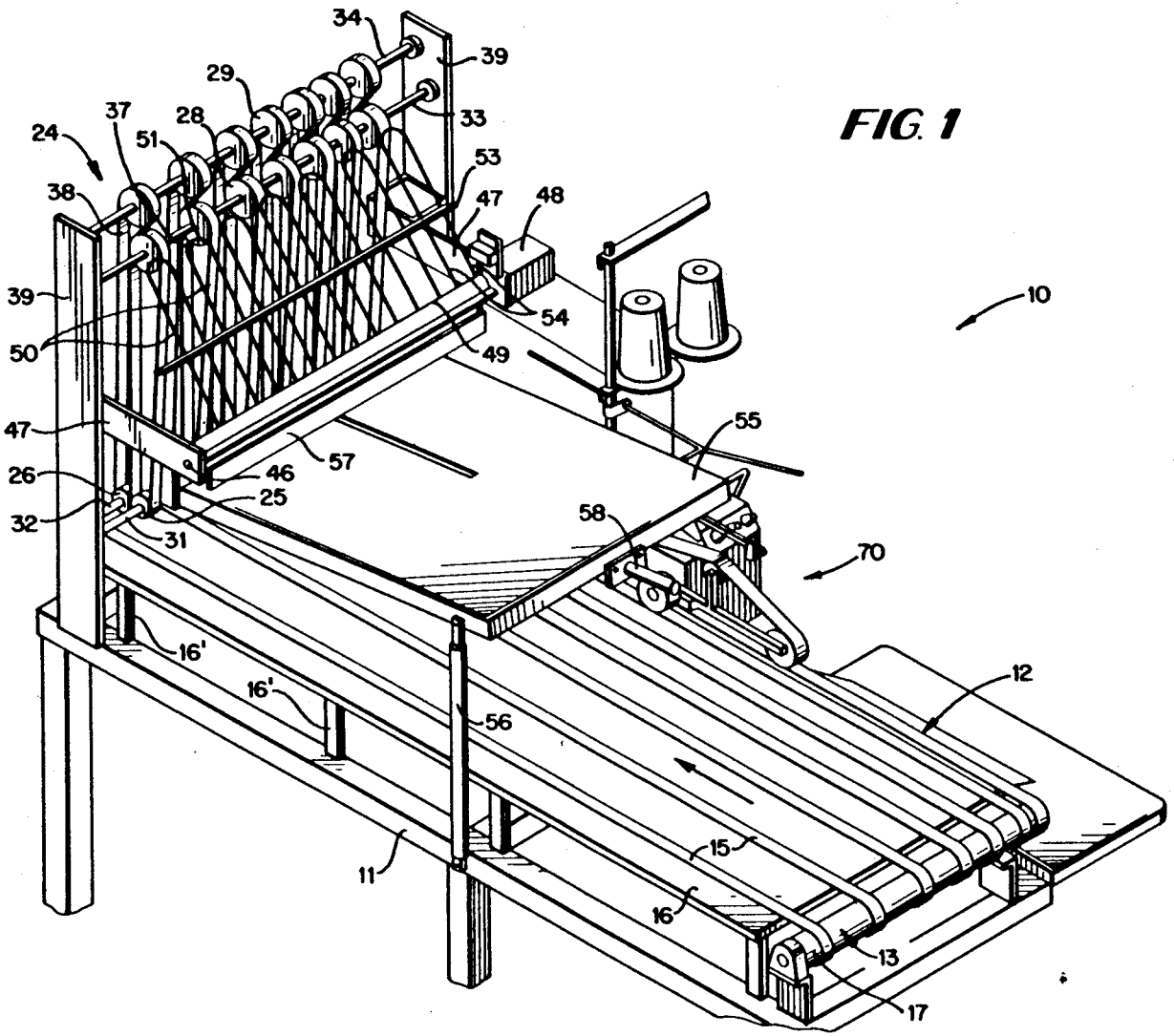
FIG. 1 is a top perspective view of exemplary apparatus according to the present invention.

Exemplary apparatus according to the present invention is shown generally by reference numeral 10 in FIG. 1. The basic apparatus comprises a frame 11 which supports a first generally horizontal conveyor means 12 and other structures. The first conveyor means 12 includes a first end 13 and a second end 14 with conveyor tapes 15 extending therebetween, the top portions of the conveyor tapes 15 disposed over a supporting surface 16. Surface 16 is supported by supporting column 16' connected between surface 16 and frame 11. The tapes 15 are horizontally spaced from each other and disposed in operative association with horizontally spaced rollers 17 which are rotatable about parallel horizontal axes at the first and second ends 13, 14, respectively. One or both of the rollers 17 is powered, as by an electric or pneumatic motor.

Figure 2:
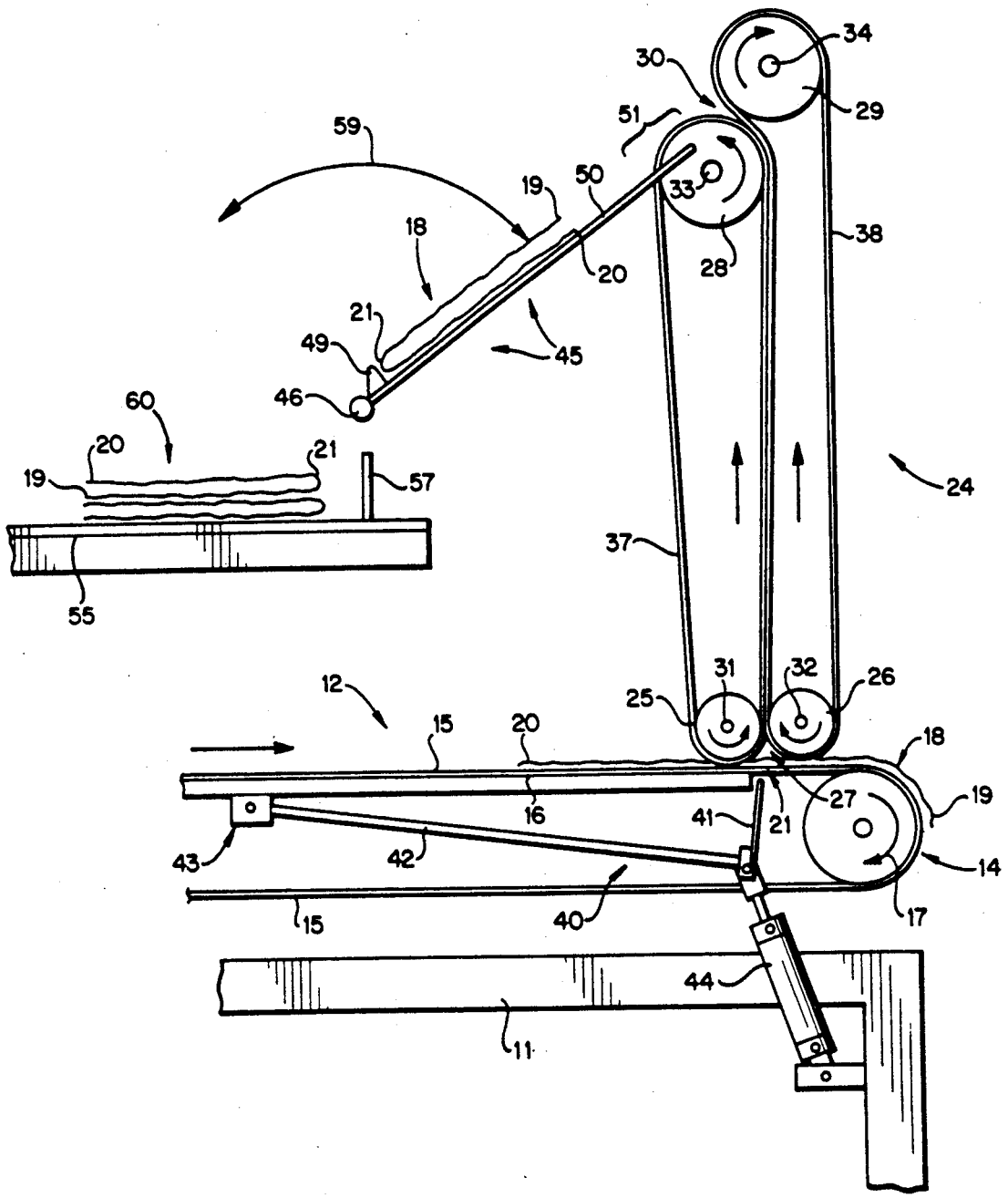
FIG. 2 is a side detail view of the particulars of the folding and stacking structures of the apparatus of FIG. 1.

Flexible drapable sheets of sheet material such as cloth garment sections 18 (see FIG. 2) are conveyed in the direction indicated by the arrows in FIGS. 1 and 2.

Each garment section 18 includes a leading edge 19, a trailing edge 20, and a center section 21.

The apparatus 10 further comprises a second generally vertically extending conveyor means 24 having rollers 25, 26 with an intake end 27 thereof, the rollers 25, 26 and the intake end 27 being disposed just above a portion of the horizontal first conveyor means 12, preferably adjacent the second end 14 thereof. The second conveyor means 24 also comprises rollers 28, 29 disposed at a top, discharge end 30 thereof. The rollers 25, 26, 28, 29 are rotated by horizontal shafts 31, 32, 33, 34, respectively. The upper rollers 28, 29 are larger in diameter than the bottom rollers 25, 26, and the rollers 28, 29 are positioned with respect to each other so that the axis of shaft 34 is above the axis of shaft 33 by a distance almost equal to the diameter of one of the rollers 28, 29, and the axis of roll 34 is positioned so that the tangential surface of the roller 29 overlaps the tangential surface of the roller 28 so the garments 18 will be discharged with both horizontal and vertical velocity components.

While the rollers 17 may be continuous, preferably the rollers 25, 26, 28 and 29 are formed by horizontally spaced roller sections (see FIG. 1) with conveyor tapes 37, 38 extending therebetween. The conveyor tapes 37, 38 are horizontally spaced from each other. One or both sets of the rollers 25, 26 and 28, 29 are driven by any conventional means to effect upward conveyance of garments from the intake end 21 to the discharge end 30 of the second conveyor 24. All of the shafts 31, 32, 33, 34 preferably are mounted on opposite ends thereof by upstanding frame elements 39 (see FIG. 1) connected to the main frame 11.

The apparatus 10 also comprises lifting means 40 (see FIG. 2) for lifting each of the sheets 18 conveyed by the first conveyor means 12 so that it operatively engages the first, intake, end 27 of the second conveyor means 24. The lifting means illustrated in FIG. 2 comprises a generally vertically extending element 41, and means for moving the element 41 from a position operatively beneath the first conveyor means 12 (see FIG. 2) to a position so that it operatively extends above the first conveyor means 12 for engaging the sheet 18 and stuffing it into the intake end 27 of the second conveyor 24. The means for moving the lifting element 41 preferably comprises the lever arm 42 pivoted at the end 43 thereof opposite to the element 41 for pivotal movement about a horizontal axis (e.g. journaled beneath the conveyor surface 16), and a fluid cylinder 44 connected to the arm 41, pneumatic or hydraulic operation of the cylinder 44 effecting upward movement of the element 41. The element 41 is dimensioned so that it fits between spaced conveyor tapes 15 of the first conveyor 12, and is positioned so that it is past the end of the support surface 16 (or so that it moves through an opening in support surface 16). While under many circumstances only one vertically extending element 41 need be provided, if desired more than one element 41 may be provided, e.g. one between each set of conveyor tapes 15.

The operation of the cylinder 44 may be controlled by an operator (as with a foot switch) or may be automatic. If automatic, it may be actuated in response to sensing (e.g. with a photocell or the like) of the leading end 19 of each garment portion 18, the cylinder 44 being automatically actuated a certain period of time after the leading end 19 of the garment is sensed (depending upon the garment length) so that a central portion 21 thereof is engaged and so that the garment 18 is folded substantially in half. A wide variety of conventional mechanisms may be utilized for sensing the garment leading end 19 and actuating the cylinder 44 in response thereto.

The apparatus also comprises stacking means disposed at the discharge end 30 of the second conveyor 24 for stacking the sheets 18 discharged from the discharge end 30. The stacking means includes a flip stacker 45, which is a structure for transferring folded sheets 18 from the second conveyor means 24 to a stacking platform or the like. A flip stacker 45 includes a shaft 46 which is mounted for pivotal movement about a generally horizontal axis by side plates 47 (see FIG. 1), and is oscillatable about the axis by any suitable power source 48, such as an oscillating electric or pneumatic motor. A stop edge 49 is provided adjacent the shaft 46, and a flexible and drapable sheet receiving surface is defined by the bent wire sections 50. The bent wire sections 50 are spaced closely enough to each other to support a flexible drapable sheet 18, but have open spaces therebetween so that they may be interleaved with the rollers 28, having free end section 51 thereof overlapping the rollers 28.

FIGS. 1 and 2 illustrate the flip stacker 45 in a first position in which free ends 51 of surface 50 are adjacent the discharge end 30 of the second conveyor 24 (interleaved with the rollers 28). The power source 48 acts upon the shaft 46 to pivot it about a horizontal axis so that it moves to a second position in which it overlies a platform onto which a folded garment 18 (see FIG. 2) in an engagement with stop 49, is to be transferred.

While the "free end" part of the sheet receiving surface 50 is preferably bent wires, the bottom portion thereof may have another construction. However, as illustrated in FIG. 1, there may be a central support bar 53 which is supported by rods 54 extending radially outwardly from the shaft 46.

The stacking means also comprises the stacking platform 55 which is mounted above the first conveyor means 12, as by support rod 56. The platform 55 may be cantilevered, or may be supported at the end thereof opposite the support 56 by other supporting structures either depending from the plate 47, or extending upwardly from the frame 11. A vertical stop lip 57 is provided at the portion thereof adjacent the flip stacker 45, preferably just below the shaft 46, and a handle 58 may be provided at the opposite end thereof, which handle 58 facilitates movement or removal of the garments onto platform 55, e.g. allowing grasping thereof and pivotal movement of the platform about the support 56 to discharge the stack of garments. Note that the flip stacker 45 moves to oscillate about the axis defined by shaft 46 as indicated by arrow 59, from one end of arrow 59 to the other (see FIG. 2). At the leftmost end of arrow 59 the surface 50 overlies the platform 55 so that the garment 18 supported thereby falls onto the platform 55 in a stack 60.

The apparatus 10 also is preferably provided in combination with a conventional automatic sewing machine and associated conveyors, thread takeoffs and the like. The automatic sewing machine is shown schematically in FIG. 1 generally by reference numeral 70. An operator standing adjacent the automatic sewing machine 70 hems the garments 18, or otherwise acts upon them with the sewing machine 70, as they are being conveyed by the first conveyor 12.

OPERATION

In the operation of the apparatus 10 to practice a method of folding and stacking drapable cloth sheets 18, the sheets 18 are substantially sequentially and automatically acted upon. First, they are conveyed by the first conveyor 12 in the horizontal direction (see arrows in FIGS. 1 and 2), and while they are being conveyed horizontally, a central portion of each sheet 18 is moved into operative association with the second conveyor 24 so that the sheet 18 is essentially folded over in half while engaged and conveyed by the second conveyor 24. This is accomplished by actuating the cylinder 44 so that the vertical element 41 engages the central portion 21 of the sheet 18 and stuffs it into the intake end 27 of the conveyor 24. Sheet 18 is then conveyed vertically upwardly by the conveyor tapes 37, 38 and discharged at the discharge end 30 vertically above the first conveyor 12.

The sheets 18 discharged at 31 have a horizontal and vertical velocity component, so that they are moved onto the surface defined by wires 50 and so that the central portion 21 thereof abuts stop 49 above shaft 46. Power source 48 rotates shaft 46 about a horizontal axis so that the folded over sheet moves in the direction of arrow 59 (see FIG. 2) from the first position (illustrated in FIG. 2) to a position in which the surface 49 overlies the platform 55. The folded over sheet 18 then falls by gravity into the stack 60 on the platform 55. The platform 55 is periodically emptied of garments.

While the actuation of the cylinder 44 may be by the operator of the automatic sewing machine 70, preferably all steps are performed automatically. For example, power source 48 may be operated in response to a sensor detecting the presence of the garment 18 on the surface 50, or in contact with the stop surface 49. The exact controlling mechanisms are conventional.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for automatically folding and stacking flexible and drapable sheets of sheet material, comprising:

a first, generally horizontally extending, conveyor means for conveying flexible and drapable sheets;

a second, generally vertically extending, conveyor means for conveying flexible and drapable sheets, having a first, intake end, disposed just above a portion of said first conveyor means, and a second, discharge end, disposed vertically above said intake end;

said second conveyor means consisting essentially of two sets of a plurality of horizontally spaced conveyor tapes; said first set extending between a first, small diameter, horizontal axis roller at the bottom of said second conveyor means, and a second, larger diameter horizontal axis roller at the top thereof, the axis of said first and second rollers being in a common substantially vertical plane; and said second set extending between a third horizontal axis roller of the same diameter as said first roller, the axes of said first and third rollers being in a common substantially horizontal plane, and a fourth horizontal axis roller having a larger diameter than said third roller, said fourth roller axis disposed above said second roller axis a distance of approximately the sum of the radii of said second and fourth rollers, and said fourth roller axis located horizontally between said second and third roller axes;

lifting means for lifting a flexible and drapable sheet conveyed by said first conveyor means so that it operatively engages said first end of said second conveyor means; and stacking means operatively disposed at the second end of said second conveyor means, cooperating with said second roller of said second conveyor means, for stacking flexible and drapable sheets discharged with said second conveyor means discharge end.

2. Apparatus as recited in claim 1 wherein said stacking means is disposed vertically above said first conveyor means.

3. Apparatus as recited in claim 1 wherein said stacking means comprises a stacking platform disposed above said first conveyor means, and means for transferring folded flexible drapable sheets from said second conveyor means to said stacking platform.

4. Apparatus as recited in claim 3 wherein said transferring means comprises means defining a flexible and drapable sheet receiving surface, having a free end and a pivoted end; means for pivotally mounting said surface at said pivoted end for pivotal movement about a horizontal axis; and means for pivoting said surface about said axis from a first position in which said free end is adjacent the discharge end of said second conveyor means, to a second position in which said surface overlies said stacking platform.

5. Apparatus as recited in claim 4 wherein said surface comprises a plurality of bent wire sections, said wire sections being closely enough spaced to support a flexible drapable sheet thereon.

6. Apparatus as recited in claim 5 wherein said lifting means comprises a generally vertically extending element and means for moving said element from a position operatively beneath said first conveyor means to a position so that it operatively extends above said first conveyor means, for engaging a flexible drapable sheet transported thereby and stuffing it into said second conveyor means intake end.

7. Apparatus as recited in claim 5 further comprising a stop edge provided adjacent said means for pivotally mounting said surface at said pivoted end.

8. Apparatus as recited in claim 1 wherein said lifting means comprises a generally vertically extending element and means for moving said element from a position operatively beneath said first conveyor means to a position so that it operatively extends above said first conveyor means, for engaging a flexible drapable sheet transported thereby and stuffing it into said second conveyor means intake end.

9. Apparatus as recited in claim 8 wherein said first conveyor means comprises a plurality of horizontally spaced horizontally extending conveyor tapes; and wherein said vertically extending element of said lifting means is dimensioned to fit between a pair of spaced tapes of said first conveyor means.

10. Apparatus as recited in claim 1 wherein said first conveyor means comprises a plurality of endless conveyor tapes wrapped around a pair of spaced rollers rotatable about parallel horizontal axes, and a generally horizontally extending support platform supporting said conveyor tapes at the portions thereof extending between the topmost surfaces of said rollers.

11. Apparatus as recited in claim 1 wherein said first, second, third and fourth rollers of said second conveyor means each comprise a plurality of horizontally spaced roller segments, each cooperating with a single conveyor tape of said second conveyor means.

12. Apparatus as recited in claim 11 wherein said wire sections are interleaved with said conveyor tapes of said second conveyor means, and overlap said second roller segments.

13. Apparatus as recited in claim 11 wherein said second conveyor mean comprises a plurality of horizontally spaced conveyor tapes; and wherein said bent wire sections are interleaved with said conveyor tapes when said wire sections are at said first position thereof, and overlap said second roller segments.

14. Apparatus as recited in claim 1 in combination with an automatic sewing machine disposed adjacent and in operative association with said first conveyor means.

15. Apparatus for stacking flexible and drapable sheets of sheet material, comprising:

a generally vertically extending conveyor means for conveying flexible and drapable sheets, having a first, intake end, and a second, discharge end, disposed vertically above said intake end; said conveyor means consisting essentially of two sets of a plurality of horizontally spaced conveyor tapes; said first set extending between a first, small diameter, horizontal axis roller at the bottom of said second conveyor means, and a second, larger diameter horizontal axis roller at the top thereof, the axis of said first and second rollers being in a common substantially vertical plane; and said second set extending between a third horizontal axis roller of the same diameter as said first roller, the axes of said first and third rollers being in a common substantially horizontal plane, and a fourth horizontal axis roller having a larger diameter than said third roller, said fourth roller axis disposed above said second roller axis a distance of approximately the sum of the radii of said second and fourth rollers, and said fourth roller axis located horizontally between said second and third roller axes; and stacking means operatively disposed at the second end of said conveyor means for stacking flexible and drapable sheets discharged from said conveyor means discharge end, said stacking means comprising: a stacking platform, and means for transferring flexible drapable sheets from said conveyor means to said stacking platform.

16. Apparatus as recited in claim 15 wherein said transferring means comprises means defining a flexible and drapable sheet receiving surface, having a free end and a pivoted end; means for pivotally mounting said surface at said pivoted end for pivotal movement about a horizontal axis; and means for pivoting said surface about said axis from a first position in which said free end is adjacent the discharge end of said conveyor means, to a second position in which said surface overlies said stacking platform.

17. Apparatus as recited in claim 16 wherein said surface comprises a plurality of bent wire sections, said wire sections being closely enough spaced to support a flexible drapable sheet thereon.

* * * * *